US011534806B2

(12) United States Patent
Xu et al.

(10) Patent No.: US 11,534,806 B2
(45) Date of Patent: Dec. 27, 2022

(54) ROLLING AND PREPARATION METHOD OF MAGNESIUM ALLOY SHEET

(71) Applicant: BAOSHAN IRON & STEEL CO., LTD., Shanghai (CN)

(72) Inventors: Shiwei Xu, Shanghai (CN); Weineng Tang, Shanghai (CN); Jianfeng Nie, Shanghai (CN); Mingzhe Bian, Shanghai (CN); Haomin Jiang, Shanghai (CN); Pijun Zhang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 334 days.

(21) Appl. No.: 15/780,476

(22) PCT Filed: Dec. 6, 2016

(86) PCT No.: PCT/CN2016/108674
§ 371 (c)(1),
(2) Date: May 8, 2019

(87) PCT Pub. No.: WO2017/101710
PCT Pub. Date: Jun. 22, 2017

(65) Prior Publication Data

US 2019/0299263 A1 Oct. 3, 2019

(30) Foreign Application Priority Data

Dec. 14, 2015 (CN) ..... 201510926259.3

(51) Int. Cl.
*B21B 1/26* (2006.01)
*B21B 1/22* (2006.01)
(Continued)

(52) U.S. Cl.
CPC ..... *B21B 1/26* (2013.01); *B21B 1/22* (2013.01); *B21B 1/227* (2013.01); *B21B 3/00* (2013.01);
(Continued)

(58) Field of Classification Search
CPC .. B21B 1/26; B21B 1/22; B21B 1/227; B21B 3/00; B21B 3/003; B21B 37/46;
(Continued)

(56) References Cited

U.S. PATENT DOCUMENTS

2013/0323523 A1* 12/2013 Oishi ..... C22C 23/02 428/544

FOREIGN PATENT DOCUMENTS

CN 101716593 A 6/2010
CN 101912876 A * 12/2010
(Continued)

OTHER PUBLICATIONS

Translation CN-104259201-A (Year: 2015).*
(Continued)

*Primary Examiner* — Brian D Walck
*Assistant Examiner* — Danielle Carda
(74) *Attorney, Agent, or Firm* — Lei Fang, Esq.; Smith Tempel Blaha LLC

(57) ABSTRACT

The present disclosure provides a high-efficient rolling process for magnesium alloy sheet. Parameters of the rolling process are: the rolling speed of each rolling pass is 10-50 m/min, the rolling reduction of each rolling pass is controlled to be 40-90%, and both the preheating temperature before rolling and the rolling temperature of each rolling pass are 250-450° C. The present disclosure also provides a preparation method for magnesium alloy sheet, comprising: 1) preparing rolling billets; 2) high-efficient hot rolling; and 3) performing annealing. The rolling process can improve
(Continued)

the mechanical performance especially, the strength and ductility of the sheet.

5 Claims, 6 Drawing Sheets

(51) Int. Cl.

| | |
|---|---|
| ***B21B 3/00*** | (2006.01) |
| ***B21B 37/46*** | (2006.01) |
| ***B21B 37/74*** | (2006.01) |
| ***C22F 1/06*** | (2006.01) |
| ***C22C 23/04*** | (2006.01) |
| ***C21D 8/02*** | (2006.01) |
| ***C22C 23/02*** | (2006.01) |

(52) U.S. Cl.
CPC ..... *B21B 3/003* (2013.01); *B21B 37/46* (2013.01); *B21B 37/74* (2013.01); *C21D 8/0226* (2013.01); *C21D 8/0231* (2013.01); *C22C 23/02* (2013.01); *C22C 23/04* (2013.01); *C22F 1/06* (2013.01); *B21B 2001/225* (2013.01); *B21B 2003/001* (2013.01); *C21D 8/02* (2013.01)

(58) Field of Classification Search
CPC ..... B21B 37/74; B21B 2001/225; B21B 2003/001; C21D 8/0226; C21D 8/0231; C21D 8/02; C22C 23/02; C22C 23/04; C22F 1/06
USPC ..... 148/551
See application file for complete search history.

(56) References Cited

FOREIGN PATENT DOCUMENTS

| | | | | | |
|---|---|---|---|---|---|
| CN | 101912876 | A | | 12/2010 | |
| CN | 103272852 | A | | 9/2013 | |
| CN | 104259201 | A | * | 1/2015 | |
| CN | 104259201 | A | | 1/2015 | |
| CN | 104313414 | A | * | 1/2015 | |
| JP | 11335761 | A | * | 12/1999 | |
| JP | 2007098470 | A | * | 4/2007 | ..... B21B 3/00 |
| JP | 2008163361 | | | 7/2008 | |
| JP | 2011157626 | | | 8/2011 | |
| JP | 2013170299 | | | 9/2013 | |
| KR | 20080006877 | A | * | 1/2008 | |

OTHER PUBLICATIONS

Translation CN-101912876-A (Year: 2010).*
Translation JP-11335761-A (Year: 1999).*
Translation KR-20080006877-A (Year: 2008).*
Translation CN-104313414-A (Year: 2015).*
Translation JP-2007098470-A (Year: 2007).*
KR Decision for Reexamination, dated Sep. 5, 2020.
KR first Office Action, dated Sep. 5, 2019.
KR Decision for Rejection, dated Sep. 5, 2019.
JP first & second Office Actions.
CN first and third Office Actions; CN Search & Supplemental Searches; CN Notification of Grant.
AU first Office Action & Notice of Allowance, dated Jan. 23, 2020.
EP first OA & Notice of Allowance.

* cited by examiner

ROLLING AND PREPARATION METHOD OF MAGNESIUM ALLOY SHEET

CROSS-REFERENCE TO RELATED APPLICATION

This application is a national stage entry pursuant to 35 U.S.C. § 371 of International Application No. PCT/CN2016/108674, filed on Dec. 6, 2016, which claims priority to Chinese Patent Application No. 201510926259.3, filed on Dec. 14, 2015, the contents of all of which are fully incorporated herein by reference.

TECHNICAL FIELD

The invention relates to a nonferrous metal processing process, in particular to a rolling process for magnesium alloy sheet.

BACKGROUND ART

So far, magnesium is the lightest metal structural material that has been discovered. For this reason, magnesium alloys, as a new metal structural material, are abundantly reserved in the world. The density of magnesium is only 1.74 g/cm$^3$, which is only ⅔ of the density of aluminum and ¼ of the density of steel. Such feature makes magnesium alloys have broad application prospects in fields of automotive, aerospace, military defense, electronic communications and home appliances. Rolling has made great progress as an important means of plastic deformation processing of metal materials. However, the application of existing magnesium alloy sheets is still very limited, and its production and usage amount are far less than steel and other nonferrous metals (such as aluminum and copper). The important issue to be solved in the further development of magnesium alloys is how to overcome various constraints so that magnesium alloys can be widely applied in related fields for manufacturing.

Factors that restrict the development of magnesium alloy sheets are as follows. First of all, magnesium alloys have hexagonal close packed crystal structure with few independent slip systems and poor processing performance at room temperature, therefore, the production of magnesium alloy sheet in prior art is carried out at high temperatures (hot rolling) using multiple passes with small reductions. Rolling magnesium alloy sheet of middle thickness by existing conventional production process requires up to over ten passes. Secondly, the single-pass reduction of magnesium alloy sheet during rolling is usually small (the single-pass reduction is usually less than 30%), which is far less than that of steel and other nonferrous metals such as aluminum and copper, resulting in more times of rolling processes, high production costs, and low production efficiency. Thirdly, it is generally believed that the plasticity of magnesium alloys decreases with the increase of strain rate, therefore, the rolling speed commonly used in rolling magnesium alloys (the rolling speed is usually less than 5 m/min) is also far less than that of steel and other nonferrous metals such as aluminum and copper, resulting in the increase of the production cost and the decrease of the production efficiency of magnesium alloy sheets. Finally, the mechanical properties of the magnesium alloy sheet are poor, and in particular, the strength and ductility of the magnesium alloy sheet need to be further improved.

The Chinese Patent Publication CN101648210A entitled "Processing method for rolling magnesium alloy sheet with low temperature, high speed and large processing amount" published on Feb. 17, 2010 discloses a processing method for magnesium alloy sheet. The processing method includes the following steps: on the basis of traditional medium sheet production technology by slab ingot heating-hot rolling technology, which includes: ingot casting (billet flattening)→face milling (edge milling)→flaw detection→homogenization→heating→hot rolling→straightening→saw cutting→surface processing→detection→oiling and packaging, the hot rolling processing in this technology is controlled in terms of rolling temperature, rolling speed (in particular finishing rolling temperature and speed), rolling reduction of each pass, passes of 8 to 10, interval time between each pass deformation and cooling speed, in this way, grain size of the magnesium alloy hot rolling sheet is controlled so as to enhance its comprehensive mechanical properties. However, the process steps of above processing method are relatively complicated, and the rolling speed is as high as 180 m/min, making the method difficult to be widely applied in practical production. In addition, the maximum single-pass processing rate in rolling is merely 30-42%, the single-pass reduction is small, and the pass processing efficiency is not high.

In addition, the Chinese patent publication CN103316915A entitled "Method for preparing wide magnesium alloy sheet" published on Sep. 25, 2013 discloses an effective method for preparing wide magnesium alloy sheet. The preparation method comprises the following steps: a fine-grained and homogeneous magnesium alloy slab with low internal stress is homogenized and then reversibly hot-rolled at a high speed. In the reversible high-speed hot-rolling process, the sheet is pressed down and deformed under huge pressure by multiple pony-roughing pass high-temperature pre-annealing and combining it with vertical roll rolling and pre-stretching, and a medium-thickness magnesium alloy sheet can be obtained after multi-pass hot-rolling; Medium-thickness sheet is obtained by the above method, then after cropping ends and shearing edges, the surface of the medium-thickness sheet is grinded and polished, then after heating and annealing, precision rolling process is performed. In the precision rolling process, the sheet is pressed down and deformed under huge pressure by multiple pony-roughing pass high-temperature pre-annealing and combining it with repeated bending deformation and high-speed asymmetrical rolling, so that high-precision magnesium alloy sheet is obtained. However, the rolling speed in the processing method disclosed in above Chinese patent document is too fast, resulting in certain safety risk. Moreover, the steps of above processing method are relatively complicated, making it difficult to be widely applied in practical production.

In summary, the existing magnesium alloy sheet preparation methods cannot effectively balance various aspects such as improvement of production efficiency, reduction of production cost, and improvement of mechanical properties. In addition, since the rolling speeds of existing magnesium alloy sheet preparation methods is either too high or too low, and the processes are complicated, for the above reasons, these methods do not have the feasibility of large-scale industrial production. Therefore, companies are in great need of obtaining a rolling process that can meet the growing demand for magnesium alloy sheet in the market.

SUMMARY

The object of present invention is to provide a high-efficiency rolling process for high-strength and high-ductility magnesium alloy sheets. The rolling process has proper rolling speed and rolling reduction per pass, and can be widely extended to related manufacturing fields. In addition, the total rolling pass of the rolling process is properly controlled, and the rolling efficiency is advantageously improved. Moreover, the use of the rolling process according to present invention effectively improves the mechanical properties of the sheet, in particular the strength and ductility of the sheet.

In order to achieve the above object, the present invention proposes a high-efficiency rolling process for high-strength and high-ductility magnesium alloy sheets. The process is a process for rolling billets. Parameters of the rolling process are: rolling speed of each rolling pass is 10~50 m/min, rolling reduction of each rolling pass is controlled to be at 40~90%, preheating the billets before rolling in each rolling pass and controlling both preheating temperature before rolling and rolling temperature in each rolling pass to be 250~450° C.

It should be noted that, in present technical solutions, the rolling reduction in each rolling pass may be same or different in the above range.

Magnesium alloys can further achieve better mechanical properties through grain refinement. In other words, grain refinement not only improves the processing plasticity and strength of the magnesium alloy materials, but also reduces its anisotropy of mechanical properties. Compared with other alloy materials such as iron and aluminum, magnesium alloy materials have larger K-factors in Hall-Petch relationship, so that the effect of grain refinement contributes more to the improvement of the strength of magnesium alloy materials. In order to further increase the strength and toughness and other mechanical properties of magnesium alloys, finer grain structures is required. In the process of deformation such as extrusion, rolling and forging, the coarse grains and the coarse second phase in the as-cast microstructure are gradually broken down and refined so that the second phase is dispersedly distributed in the magnesium matrix, as a result, the mechanical properties of magnesium alloys are further improved and higher strength and better plasticity are achieved.

The microstructure characteristics (such as grain size, texture, etc.) of the rolled magnesium alloy sheet have a close relationship with the rolling speed, single-pass reduction (especially the finishing rolling reduction), rolling temperature, annealing temperature and annealing time in the rolling process. On the one hand, when the magnesium alloy material is rolled under high speed, the deformation heat generated by the deformation and the frictional heat generated by the contact between the rolled piece and the roller will cause rise of actual temperature of the rolling piece and initiation of more deformation modes, then the deformability of the alloy is improved, this will introduce more dislocations into the microstructure of the magnesium alloy sheet, induce dynamic recrystallization, refine the deformed grains, and obtain a magnesium alloy sheet having a finer grain structure. On the other hand, improving the rolling deformation strain also helps to obtain a more refined microstructure during rolling deformation. Deformation is the source of the driving force for the recrystallization of the sheet. Meanwhile, the amount of reduction determines the degree of deformation and the amount of energy stored in the deformation, thereby affecting the nucleation rate of the static recrystallization, and finally determining the size of grains in static recrystallization. The greater amount of deformation can introduce more distortion energy into the structure of magnesium alloy to reduce the initial temperature of dynamic recrystallization, which is more conducive to obtaining a more refined microstructure in magnesium alloy sheet. Therefore, the use of a rolling process in which a relatively high rolling speed is combined with a relatively large rolling reduction not only effectively obtains a fine-grained structure which improves the mechanical properties of magnesium alloy sheet, but also advantageously improves the working efficiency of rolling.

Based on the technical solutions of present invention, it is expected to obtain a fine deformed structure in magnesium alloy sheet by adopting a relatively high rolling speed and combining with a large amount of rolling deformation. For rolled magnesium alloy sheet, the rolling speed mainly affects its deformation rate. The effect of deformation rate on rolling speed is mainly in two aspects: on the one hand, the deformation rate affects the actual rolling temperature of the rolling process during deformation process; on the other hand, the deformation rate affects the deformation mode that can be initiated during rolling. These two aspects comprehensively determine the final rollability of the rolled piece at a specific rolling temperature. The inventors found that in the actual production process, when the rolling speed is 12.1 m/min, the single-pass reduction reaches 60% at an appropriate rolling temperature, and dynamic recrystallization is accompanied. Therefore, increasing the rolling speed not only effectively improves the rolling ability of magnesium alloy sheet, but also realizes the application of rolling with a large reduction amount. However, if the rolling speed is too high, the deformation heat due to deformation and frictional heat generated by the contact between rolled piece and roller will cause a substantial increase in the actual temperature of the rolled piece, which may induce dynamic recrystallization and grain growth since the rolling temperature (i.e. dynamic recrystallization temperature) of the rolled piece is difficult to control in the actual production process. As a result, the recrystallization of the magnesium alloy sheet structure is incomplete or the recrystallized grains are relatively coarse, resulting in poor final mechanical properties of the magnesium alloy sheet. Therefore, the rolling speed should not exceed 50 m/min. However, if the rolling speed is too slow, the deformation heat due to deformation and frictional heat generated by the contact between rolled piece and roller are insufficient to cause an increase in the actual temperature of the rolled piece, in contrast, some heat of the rolled piece will lost due to the contact between the preheated rolled piece and the roller which is at room temperature. Therefore, rolling at a slow speed cannot achieve a large rolling reduction during rolling, either. The small amount of reduction lead to low deformation energy storage and low dislocation density, resulting in insufficient driving force for nucleation in the static recrystallization process, which is detrimental to grain refinement and will hinder the improvement of the strength of the magnesium alloy sheet. Hence, the rolling speed of rolling passes should be controlled within the range of 10~50 m/min.

In addition, an increase of the rolling reduction is beneficial to the increase of deformation energy stored in the sheet, resulting in a higher dislocation density of the magnesium alloy sheet and a greater driving force for static recrystallization nucleation, thereby grains can be effectively refined and the strength and ductility of the sheet can be improved. The inventors also found that the reduction of each pass has an important influence on the microstructure of the magnesium alloy sheet. With the increase of the reduction, the dislocation density in the grains of the magnesium alloy sheet increases, the lattice distortion increases, and the number of recrystallized grain nucleates increases, resulting in a significant refinement of the grains in the sheet.

However, if single-pass reduction is too big, the risk of cracking in rolled piece increases significantly. Therefore, the single-pass reduction should not exceed 90%. On the other hand, if the single-pass reduction is too small, the deformed energy storage and dislocation density are low, resulting in insufficient driving force for nucleation during static recrystallization and fewer nucleation sites, which is detrimental to the grain refinement of the magnesium alloy sheet. Therefore, in the high-efficiency rolling process for high-strength and high-ductility magnesium alloy sheets according to present invention, the single-pass reduction of each rolling pass should be 40% or more and 90% or less.

Since the rolling reduction of each rolling pass in the above technical solution is controlled to be 40~90% and the rolling reduction per pass is improved. Therefore, comparing with existing rolling processes, the rolling process of present invention has fewer rolling passes simplified process steps, less rolling time and higher working efficiency.

In addition, on the basis of controlling the rolling speed and the rolling reduction of a single pass, controlling the rolling temperature can effectively improve the mechanical properties of the magnesium alloy sheet. In the technical solution of present invention, the reasons for controlling the preheating temperature before rolling and the rolling temperature of the each rolling pass between 250~450° C. are as follows: if the temperature is too high, the grains grow rapidly at high temperatures before and after rolling, so that the effect of grain refinement by rolling deformation is reduced; if the temperature is too low, the plastic deformation ability of the material is low, and the rolled sheet is easily cracked, and even the raw material may break.

Further, in the high-efficiency rolling process for high-strength and high-ductility magnesium alloy sheets according to present invention, the preheating time before rolling in each rolling pass is controlled to 1~15 min.

Another object of present invention is to provide a preparation method for high-strength and high-ductility magnesium alloy sheets. A magnesium alloy sheet having high strength and good ductility can be obtained through the preparation method. In addition, the preparation method has simple steps, requires less time, and has high production efficiency. In addition, the preparation method for high-strength and high-ductility magnesium alloy sheets according to the present invention has a low production cost and can be widely extended to related manufacturing fields.

In order to achieve the above purpose of the invention, the present invention provides a preparation method for high-strength and high-ductility magnesium alloy sheets, wherein includes the steps of:

(1) preparing rolling billets;

(2) hot rolling the billets to target level effectively, wherein rolling speed of each rolling pass is 10~50 m/min, rolling reduction of each rolling pass is controlled to be 40~90%, preheating the billets before rolling in each rolling pass and controlling both preheating temperature before rolling and rolling temperature in each rolling pass to be 250~450° C.;

(3) annealing.

Further, in the preparation method according to present invention, in step (2), the preheating time before rolling in each rolling pass is controlled to 1~15 min.

By controlling the rolling speed, rolling reduction in a single pass and rolling temperature in the hot rolling process, not only can the mechanical properties of the magnesium alloy sheet be effectively improved, but also the rolling efficiency of the magnesium alloy sheet can be advantageously improved. Since the design principle of the parameter control of the rolling process has been described in detail above, the design principle of the parameter control of the above hot rolling process will not be further described here.

It should be noted that the rolling reduction of each rolling pass in efficient hot rolling is controlled to be 40~90%, that is, the rolling reduction per pass is improved compared with that of the prior art. Therefore, comparing with rolling processes in the prior art, the preparation method of this invention has fewer hot rolling passes, simplified hot rolling process steps, less hot rolling time and higher working efficiency.

Further, in the above step (3), annealing temperature is 150~400° C. and annealing time is 10~300 s.

Annealing temperature and annealing time have great influences on the recrystallized grain size of the sheet. If the annealing temperature is too high, the growth rate of the grain in static recrystallization is too high, making it difficult to obtain fine recrystallized grains. If the annealing temperature is too low, the deformed energy storage is insufficient for the energy required for the static recrystallization at the temperature, so that static recrystallization does not occur and the grain cannot be further refined. Meanwhile, the deformed grains form fine grains by static recrystallization at a certain annealing temperature and grow gradually as the annealing time increases. Moreover, the recrystallized grains become coarse if the heat preservation time is too long, which is unfavorable to the improvement of the strength of the magnesium alloy sheet. On the other hand, static recrystallization may not occur if the heat preservation time is too short, so that the crystal grains cannot be further refined by recrystallization. Therefore, according to the composition and deformation of the magnesium alloy sheet, the annealing temperature should be controlled within the range of 150~400° C. and the annealing time should be controlled within the range of 10~300 s to effectively refine the grain size of the magnesium alloy sheet, thereby greatly improving the room-temperature strength and elongation of the magnesium alloy sheet.

In certain embodiments, step (1) preparing rolling billets of the preparation method of the present invention comprises smelting, casting ingot, homogenization treatment, sawing ingot and rough rolling.

Furthermore, in the above step (1), rolling speed in each pass of rough rolling is controlled to be 10~50 m/min.

Furthermore, in the above step (1), the rolling reduction in each pass of rough rolling is controlled to be 10~30%.

Considering the conditions for biting the slab ingots into the sheet, step (1) uses a rolling reduction that is smaller than the rolling reduction of each rolling pass in step (2). Therefore, the rolling reduction in each pass during rough rolling process is controlled to be 10~30%, which is smaller than the rolling reduction of each pass in the efficient hot rolling process.

Further, in the above step (1), the billets are preheated before each pass of rough rolling, and the preheating temperature and the rolling temperature in each pass of rough rolling are controlled to be 250~450° C.

The reasons for controlling the preheating temperature and the rolling temperature in each pass of rough rolling within the range of 250~450° C. in step (1) are as follows: if the temperature is too high, the grains grow rapidly at high temperatures before and after rolling, so that the effect of grain refinement by rolling deformation is reduced; if the temperature is too low, the plastic deformation ability of the material is low, and the rolled sheet is easily cracked, and even the raw material may break.

In some embodiments, in step (1) of the preparation method described in the present invention, the rolling billet can be prepared by a twin-roll casting method. Since the method is a conventional process in prior art, it will not be further described here.

The preparation method for high-strength and high-ductility magnesium alloy sheets of present invention uses a relatively fast rolling speed and has a relatively large rolling reduction, which results in magnesium alloy sheet having high deformation energy storage but not yet undergoing dynamic recrystallization undergoes short annealing at subsequent lower annealing temperature. As a result, fine crystal grains resulting from static recrystallization are formed in the magnesium alloy sheet, thereby obtaining a magnesium alloy sheet having improved strength and plasticity.

In addition, in the preparation method for high-strength and high-ductility magnesium alloy sheets, the magnesium alloy sheet with high strength and good plasticity can be obtained by only controlling parameters in rolling and annealing processes. The process steps are simple and convenient, production efficiency is high. It not only improves the mechanical properties of the magnesium alloy sheet, but also reduces the production cost of the magnesium alloy sheet. The preparation method has high practical application value and can be extensively extended to related manufacturing fields.

The high-efficiency rolling process for high-strength and high-ductility magnesium alloy sheets of present invention have proper rolling speed and pass reduction, and can be extensively extended to relevant manufacturing fields.

In addition, the high-efficiency rolling process for high-strength and high-ductility magnesium alloy sheets has a proper total rolling pass, which advantageously improves the rolling efficiency.

In addition, the use of the high-efficiency rolling process for high-strength and high-ductility magnesium alloy sheets of present invention effectively improves the mechanical properties of the sheet, and in particular greatly improves the strength and ductility of the sheet.

Through the preparation method for high-strength and high-ductility magnesium alloy sheets of the present invention, the strength and the plasticity of the magnesium alloy sheet are improved.

In addition, the preparation method for high-strength and high-ductility magnesium alloy sheets has good rollability.

In addition, the preparation method for high-strength and high-ductility magnesium alloy sheets greatly reduces the number of rolling passes, thereby effectively reducing the time required for production and preparation, increasing the production efficiency, and further reducing the production cost.

Moreover, the preparation method for high-strength and high-ductility magnesium alloy sheets has simple steps and can be widely extended to related manufacturing fields.

DETAILED DESCRIPTION

Figure 1:
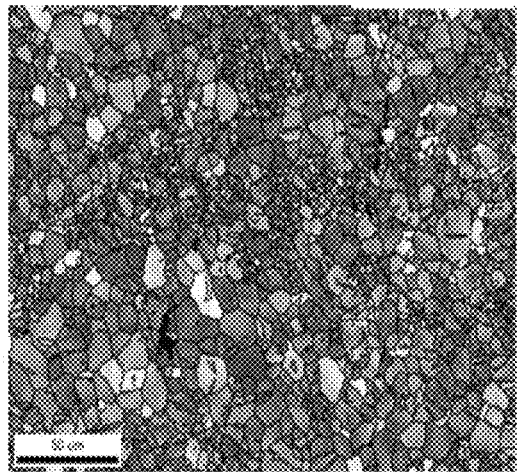
FIG. 1 is a micrograph after the annealing step of Comparative Example B1.

The following further describes and illustrates the high-efficiency rolling process for high-strength and high-ductility magnesium alloy sheets and the preparation method for high-strength and high-ductility magnesium alloy sheets according to the present invention with reference to the drawings and specific Examples, whereas the explanation and demonstration do not improperly limit the technical solutions of the present invention.

EXAMPLES A1-A6 AND COMPARATIVE EXAMPLES B1-B9

The above Examples A1~A6 are obtained by the preparation method for high-strength and high-ductility magnesium alloy sheets of the present invention, which includes the following steps:

(1) Preparing rolling billets:

wherein, the preparation process of the rolling billets in Examples A1~A2, A4, A5 is as follows:

(1a) melting: the raw materials were placed in a steel crucible and mixed; the crucible and raw materials were then placed in an induction furnace and heated to 760° C. for melting; during the melting process, argon gas was injected into the induction furnace as a protective atmosphere to prevent combustion;

(1b) casting ingot: after the melting, the molten magnesium alloy liquid was casted in a preheated steel mold at 200° C.; the ingot size is 55 mm (length)*30 mm (width)*120 mm (height);

(1c) homogenization treatment: homogenizing at 300° C. for 12 hr, and then homogenizing at 430° C. for 4 hr;

(1d) sawing ingot: after homogenization, the ingots were sawn into slabs with a thickness of 5 mm according to thickness requirements;

(1e) rough rolling: parameters of the rolling process were as follows: the roll diameter was 75 mm, the rolling speed of each pass was 10~50 m/min, the reduction of each pass was 10~30%, the billets were preheated before rolling in each rolling pass, the preheating temperature before rolling and the rolling temperature were 250~450° C., and the heat preservation time of preheating was 1~15 min.

By rolling the billets of Examples A3 and A6 with twin rollers, an AZ31 alloy billet with an initial thickness of 2 mm was obtained.

(2) High-efficiency hot rolling: the roll diameter was 75 mm, the rolling speed of each pass was 10~50 m/min, the reduction of each pass was 40~90%, the billets were preheated before rolling in each rolling pass, the preheating temperature before rolling and the rolling temperature were 250~450° C., and the heat preservation time of preheating was 1~15 min.

(3) Annealing: the annealing temperature was 150~400° C. and the annealing time was 10~300 s.

It should be noted that the rolling billets of Comparative Examples B5, B6 and B9 were also prepared by twin-roll casting, while Comparative Examples B1~B4, B7, B8 were obtained by steps of melting, casting ingot, homogenization treatment, sawing ingot and rough rolling.

Table 1 shows specific process parameters of Examples A1~A6 and Comparative Examples B1~B9.

TABLE 1

| | Step (1) | | | | | | Step (2) |
|---|---|---|---|---|---|---|---|
| Example number* | Alloy composition and conditions | Rough rolling speed (m/min) | Rough rolling single-pass reduction (%) | Rough rolling temperature (° C.) | Preheating time before rolling (min) | Total pass in rough rolling | High-efficient hot rolling speed (m/min) |
| A1 | Mg—3Al—1Zn—0.3Mn cast magnesium alloy | 15 | 20 | 400 | 6 | 4 | 15 |
| A2 | Mg—1Zn—0.2Nd—0.2Zr cast magnesium alloy | 45 | 30 | 400 | 6 | 3 | 15 |
| A3 | Mg—3Al—1Zn—0.3Mn twin-roll cast magnesium alloy | — | — | — | — | — | 15 |
| A4 | Mg—3Al—1Zn—0.3Mn cast magnesium alloy | 50 | 20 | 450 | 1 | 4 | 40 |
| A5 | Mg—1Zn—0.2Nd—0.2Zr cast magnesium alloy | 10 | 10/20/30 | 260 | 15 | 3 | 10 |
| A6 | Mg—3Al—1Zn—0.3Mn twin-roll cast magnesium alloy | — | — | — | — | — | 50 |

| | Step (2) | | | | Step (3) | |
|---|---|---|---|---|---|---|
| Example number* | High-efficiency hot rolling single-pass reduction (%) | Rolling temperature (° C.) | Preheating time before rolling (min) | Total pass of high-efficient hot rolling | Annealing temperature (° C.) | Annealing time (s) |
| A1 | 50 | 400 | 6 | 1 | 200 | 60 |
| A2 | 50 | 400 | 6 | 1 | 300 | 60 |
| A3 | 50 | 400 | 1 | 1 | 200 | 60 |
| A4 | 90 | 450 | 1 | 1 | 150 | 300 |
| A5 | 43 | 260 | 15 | 1 | 400 | 10 |
| A6 | 80 | 420 | 5 | 1 | 200 | 280 |

| | Step (1) | | | | | | |
|---|---|---|---|---|---|---|---|
| Comparative Example number | Alloy composition and conditions | Hot rolling speed (m/min) | Hot rolling single-pass reduction (%) | Rolling temperature (° C.) | Preheating time before rolling (min) | Total pass in hot rolling | Step (2) Hot rolling speed (m/min) |
| B1 | Mg—3Al—1Zn—0.3Mn cast magnesium alloy | 15 | 20 | 400 | 6 | 4 | 15 |
| B2 | Mg—3Al—1Zn—0.3Mn cast magnesium alloy | 15 | 20 | 400 | 6 | 3 | 15 |
| B3 | Mg—1Zn—0.2Nd—0.2Zr cast magnesium alloy | 45 | 30 | 400 | 6 | 3 | 15 |
| B4 | Mg—1Zn—0.2Nd—0.2Zr magnesium alloy | 45 | 30 | 400 | 6 | 3 | 15 |
| B5 | Mg—3Al—1Zn—0.3Mn twin-roll cast magnesium alloy | — | — | — | — | — | 15 |
| B6 | Mg—3Al—1Zn—0.3Mn twin-roll cast magnesium alloy | — | — | — | — | — | 15 |
| B7 | Mg—3Al—1Zn—0.3Mn cast magnesium alloy | 2 | 20 | 450 | 1 | 4 | 2 |
| B8 | Mg—1Zn—0.2Nd—0.2Zr cast magnesium alloy | 2 | 10/20/20/20 | 300 | 15 | 4 | 2 |
| B9 | Mg—3Al—1Zn—0.3Mn twin-roll cast magnesium alloy | — | — | — | — | — | 2 |

| | Step (2) | | | | Step (3) | |
|---|---|---|---|---|---|---|
| Comparative Example number | Hot rolling single-pass reduction (%) | Rolling temperature (° C.) | Preheating time before rolling (min) | Total pass of hot rolling | Annealing temperature (° C.) | Annealing time (s) |
| B1 | 10 | 400 | 6 | 1 | 200 | 60 |
| B2 | 30 | 400 | 6 | 1 | 200 | 60 |
| B3 | 10 | 400 | 6 | 1 | 300 | 60 |
| B4 | 30 | 400 | 6 | 1 | 300 | 60 |
| B5 | 10 | 400 | 1 | 1 | 200 | 60 |

TABLE 1-continued

| | | | | | | |
|---|---|---|---|---|---|---|
| B6 | 30 | 400 | 1 | 1 | 200 | 60 |
| B7 | 30 | 450 | 1 | 3 | 200 | 1800 |
| B8 | 30 | 300 | 15 | 1 | 400 | 1800 |
| B9 | 20 | 400 | 5 | 3 | 350 | 1800 |

*Note:
For the multi-pass rolling in the table, if there is only one value for single-pass reduction, it means that the reductions in each pass are the same.

Magnesium alloy sheets of Examples A1~A6 and Comparative Examples B1~B9 were sampled and the middle portion of the samples were taken to observe the microstructures of the sheet. The microstructures of the sheets are shown in the following figures. The relevant mechanical properties were determined by conventional tensile test methods; wherein the tensile strain rate was $10^{-3}$/s and the gauge length was 10 mm. The results obtained after the tests are shown in Table 2.

Table 2 shows the parameters of mechanical properties of Examples A1~A6 and Comparative Examples B1~B9.

TABLE 2

| Number* | Yield strength (MPa) | Tensile strength (MPa) | Uniform elongation (%) | Elongation (%) |
|---|---|---|---|---|
| A1 | 243 | 300 | 13 | 24 |
| A2 | 244 | 265 | 8 | 29 |
| A3 | 263 | 304 | 10 | 20 |
| A4 | 245 | 308 | 20 | 26 |
| A5 | 234 | 255 | 16 | 31 |
| A6 | 265 | 318 | 15 | 24 |
| B1 | 221 | 270 | 9 | 15 |
| B2 | 235 | 280 | 11 | 20 |
| B3 | 215 | 236 | 7 | 14 |
| B4 | 238 | 259 | 7 | 18 |
| B5 | 255 | 291 | 8 | 16 |
| B6 | 261 | 303 | 8 | 13 |
| B7 | 119 | 230 | 15 | 23 |
| B8 | 141 | 212 | 9 | 30 |
| B9 | 195 | 264 | 12 | 22 |

As can be seen from Table 2, all yield strengths of Examples A1~A6 are 234 MPa or more and all tensile strengths of Examples A1~A6 are 255 MPa or more, which indicates that the magnesium alloy sheets of Examples have relatively high strengths; the uniform elongations of Examples A1~A6 are 8% or more and the elongations of Examples A1~A6 are 20% or more, which indicates that the magnesium alloy sheets of Examples have high ductility and good plasticity. The yield strength, tensile strength, uniform elongation and elongation of Examples A1~A6 are all higher than the yield strength, tensile strength, uniform elongation and elongation of the corresponding Comparative Examples. In particular, the yield strengths of the magnesium alloy sheets of Examples are greatly improved. For example, compared with the yield strength of Comparative Example B9 (195 MPa), the yield strength of Example A6 (265 MPa) increased by 35.9%; compared with the yield strength of Comparative Example B8 (141 MPa), the increase in the yield strength of Example A5 (234 MPa) reached about 66%; compared with the yield strength of the comparative example B7 (119 MPa), the yield strength of the example A4 (245 MPa) even increased by about 106%.

Figure 2:
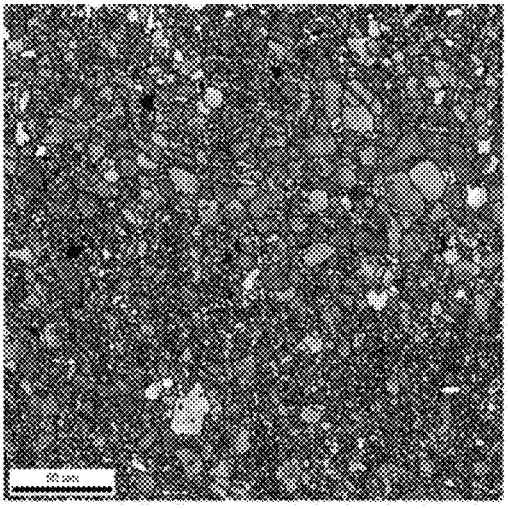
FIG. 2 is a micrograph after the annealing step of Comparative Example B2.
Figure 3:
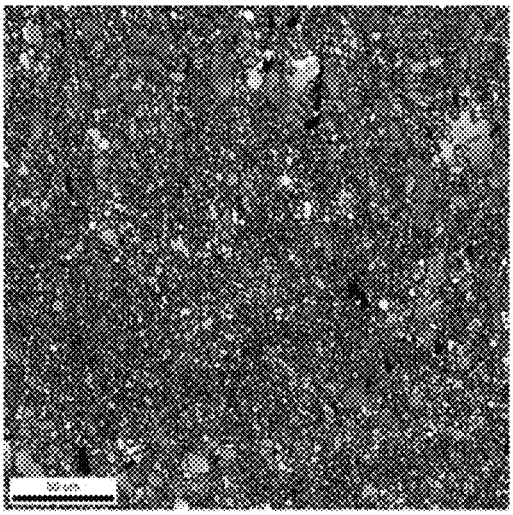
FIG. 3 is a micrograph after the annealing step of Example A1.

FIGS. 1, 2 and 3 show the microstructure after the annealing step of Comparative Example B1, Comparative Example B2 and Example A1, respectively.

As shown in FIG. 1, if necessary, refer to Table 1: the single-pass reduction in Comparative Example B1 is 10%; the deformation of the magnesium alloy sheet is small due to the small reduction, thus making the recrystallization of the sheet incomplete. The fraction of recrystallized grains is only 22%, and the grains are coarse, the average grain size is about 9 μm.

As shown in FIG. 2, if necessary, refer to Table 1: the single-pass reduction in Comparative Example B2 is 30%, which is larger than that of Comparative Example B1, resulting in a relatively large deformation of the magnesium alloy sheet; although the recrystallization of the magnesium alloy sheet of Comparative Example B2 is still incomplete, the fraction of recrystallized grains thereof is about 40%, higher than that of Comparative Example B1, and the average grain size thereof is smaller, about 6 μm.

As shown in FIG. 3, if necessary, refer to Table 1: the single-pass reduction in Example A1 is 50%, which is larger than that of Comparative Examples B1 and B2. The deformation of the magnesium alloy sheet is larger, the grain structure of the magnesium alloy sheet is clearly refined, and the large-size deformed grains are greatly reduced. Compared with the grain sizes of the magnesium alloy sheets of Comparative Examples B1 and B2 shown in FIGS. 1 and 2, the grain size of Examples A1 shown in FIG. 3 is smaller and the grain size thereof is more uniform. The average grain size is about 4 μm and the fraction of recrystallized grains reaches about 68%.

As shown in FIGS. 1 and 2 and in combination with the contents shown in Table 1, since Comparative Examples B1 and B2 use relatively low single-pass reductions, the recrystallized grain sizes are relatively large and the effects of recrystallization on grain refinement are not obvious in the microstructures after the annealing step of Comparative Examples B1 and B2. As shown in FIG. 3 and in combination with the contents shown in Table 1, since Example A1 uses a relatively high single-pass reduction, the degree of recrystallization is high, the grain size is small and the grain size is uniform in the microstructure of Example A1.

Figure 4:
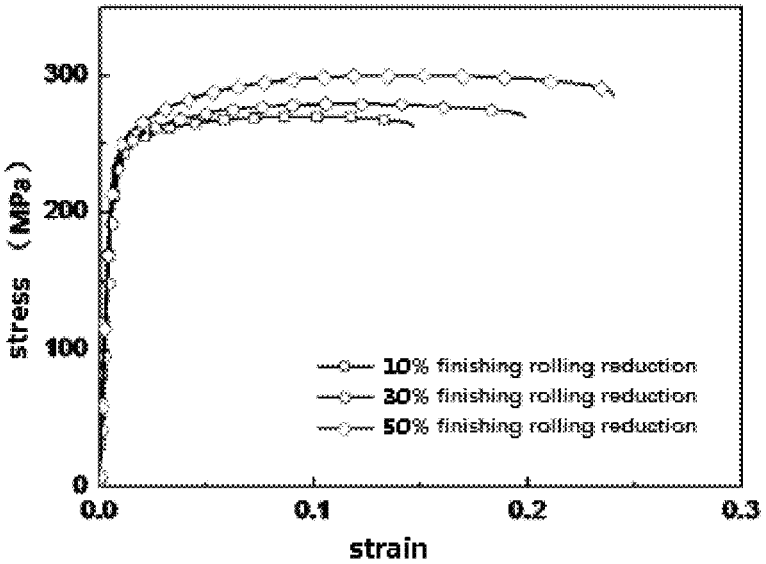
FIG. 4 is a graph showing the relationship between the reduction and the tensile curve at room temperature of Example A1, Comparative Example B1, and Comparative Example B2.

FIG. 4 shows the relationship between the single-pass reduction and the tensile curve at room temperature of Example A1, Comparative Example B1 and Comparative Example B2.

As shown in FIG. 4 and in combination with Tables 1 and 2, the single-pass reduction in Comparative Example B1 is 10%, the single-pass reduction in Comparative Example B2 is 30%, while the single-pass reduction in Example A1 is 50%; the mechanical properties of the magnesium alloy sheet increase with the increase of the single-pass reduction. Specifically, the yield strength, tensile strength, uniform elongation and elongation of Example A1 are all higher than the yield strength, tensile strength, uniform elongation and elongation of Comparative Examples B1 and B2.

Figure 5:
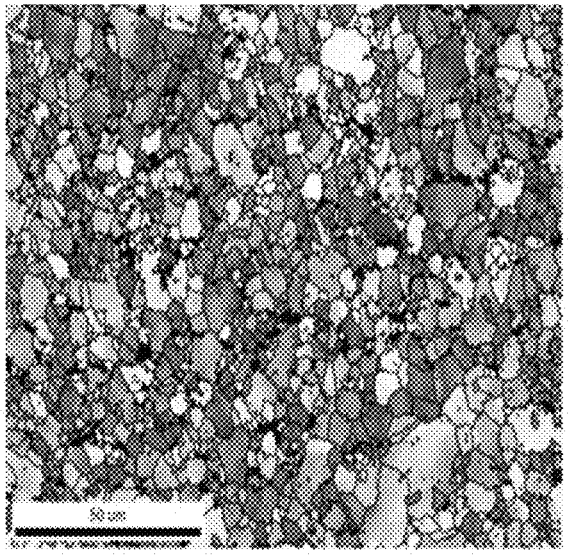
FIG. 5 is a micrograph after the annealing step of Comparative Example B3.
Figure 6:
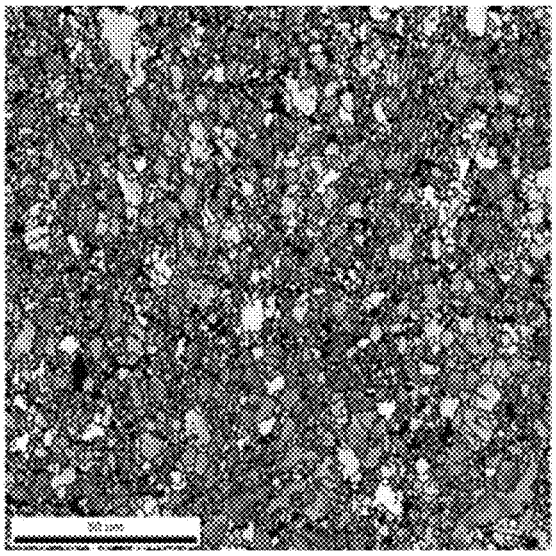
FIG. 6 is a micrograph after the annealing step of Comparative Example B4.
Figure 7:
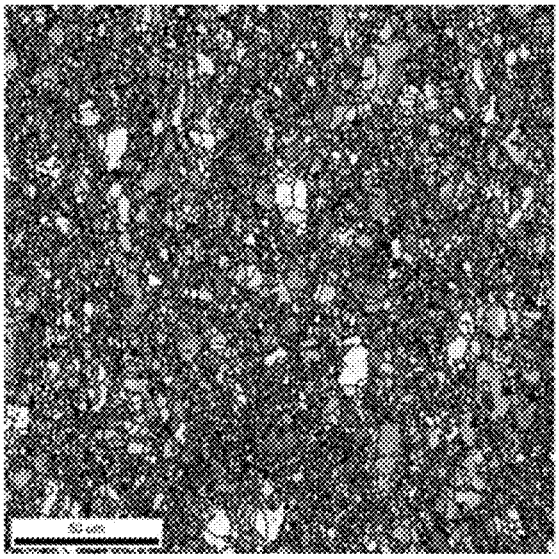
FIG. 7 is a micrograph after the annealing step of Example A2.

FIGS. 5, 6 and 7 show the microstructures after the annealing step of Comparative Example B3, Comparative Example B4 and Example A2, respectively.

As shown in FIG. 5, if necessary, refer to Table 1: the single-pass reduction in Comparative Example B3 is 10%; the deformation of the magnesium alloy sheet is small due to the small reduction, thus making the recrystallization of the sheet incomplete. The fraction of recrystallized grains is only 30%, and as shown in FIG. 5, the grains are coarse, and the average grain size is about 7 μm.

As shown in FIG. 6, if necessary, refer to Table 1: the single-pass reduction in Comparative Example B4 is 30%, which is larger than that of Comparative Example B3, resulting in a relatively large deformation of the magnesium alloy sheet; although the recrystallization of the magnesium alloy sheet of is still incomplete, the fraction of recrystallized grains thereof is about 48%, higher than that of Comparative Example B3 and the average grain size thereof is smaller, about 4 μm.

As shown in FIG. 7, if necessary, refer to Table 1: the single-pass reduction in Example A2 is 50%, which is larger than that of Comparative Examples B3 and B4. The deformation of the magnesium alloy sheet is larger, the grain structure of the magnesium alloy sheet is clearly refined, and the large-size deformed grains are greatly reduced. Compared with the grain sizes of the magnesium alloy sheets of Comparative Examples B3 and B4 shown in FIGS. 5 and 6, the grain size of Examples A2 shown in FIG. 7 is smaller and the grain size thereof is more uniform. The average grain size is about 3 μm and the fraction of recrystallized grains reaches about 66%.

As shown in FIGS. 5 and 6 and in combination with the contents shown in Table 1, since Comparative Examples B3 and B4 use relatively low single-pass reductions, the recrystallized grain sizes are relatively large and the effects of recrystallization on grain refinement are not obvious in the microstructures after the annealing step of Comparative Examples B3 and B4. As shown in FIG. 7 and in combination with the contents shown in Table 1, since Example A2 uses a relatively high single-pass reduction, the effect of recrystallization is obvious, the grain size is small and the grain size is uniform in the microstructure of Example A2.

Figure 8:
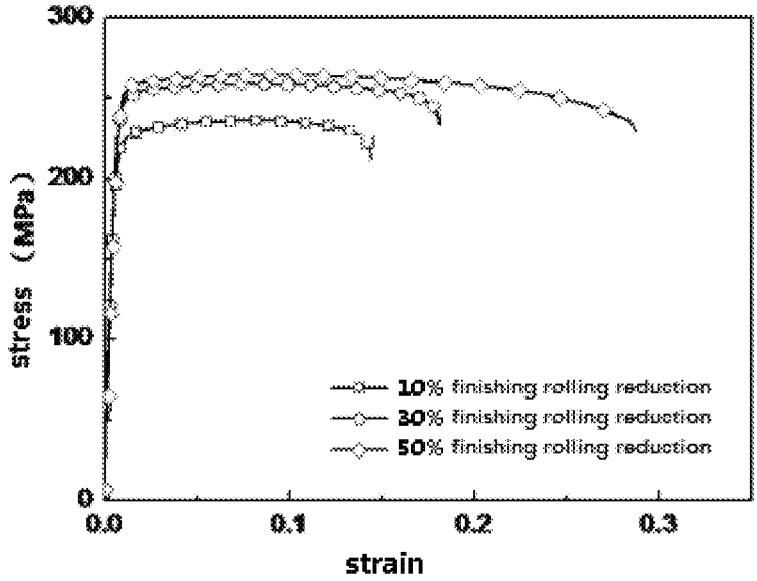
FIG. 8 is a graph showing the relationship between the reduction and the tensile curve at room temperature of Example A2, Comparative Example B3, and Comparative Example B4.

FIG. 8 shows the relationship between the single-pass reduction and the tensile curve at room temperature of Example A2, Comparative Example B3 and Comparative Example B4.

As shown in FIG. 8 and in combination with Tables 1 and 2, the single-pass reduction in Comparative Example B3 is 10%, the single-pass reduction in Comparative Example B4 is 30%, while the single-pass reduction in Example A2 is 50%; the stress and strain index of the magnesium alloy sheet increase with the increase of the single-pass reduction. Specifically, the yield strength, tensile strength, uniform elongation and elongation of Example A2 are all higher than the yield strength, tensile strength, uniform elongation and elongation of Comparative Examples B3 and B4.

Figure 9:
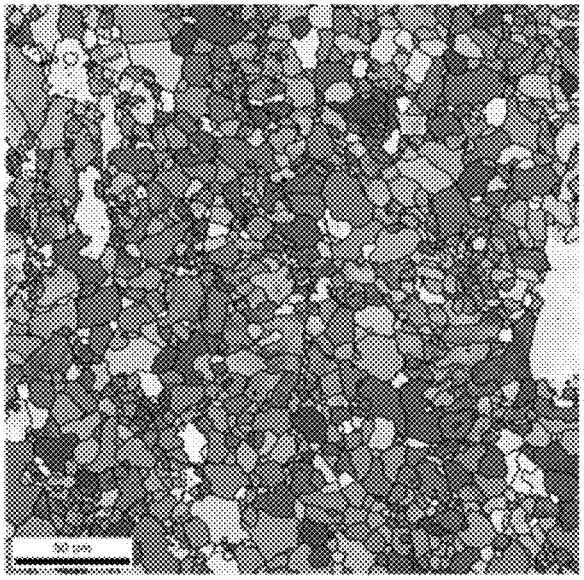
FIG. 9 is a micrograph after the annealing step of Comparative Example B5.
Figure 10:
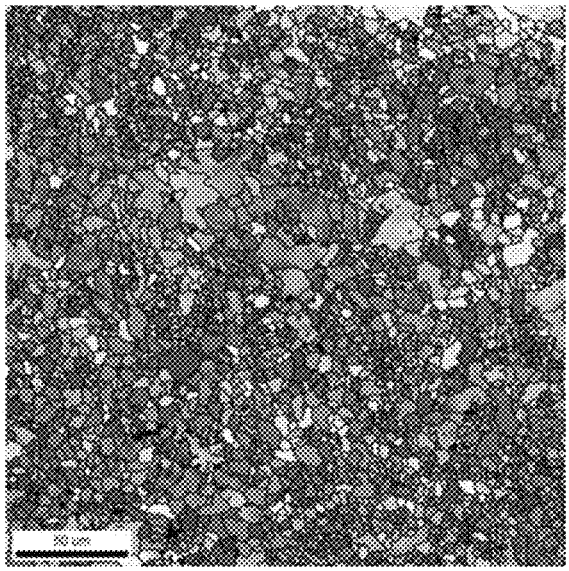
FIG. 10 is a micrograph after the annealing step of Comparative Example B6.
Figure 11:
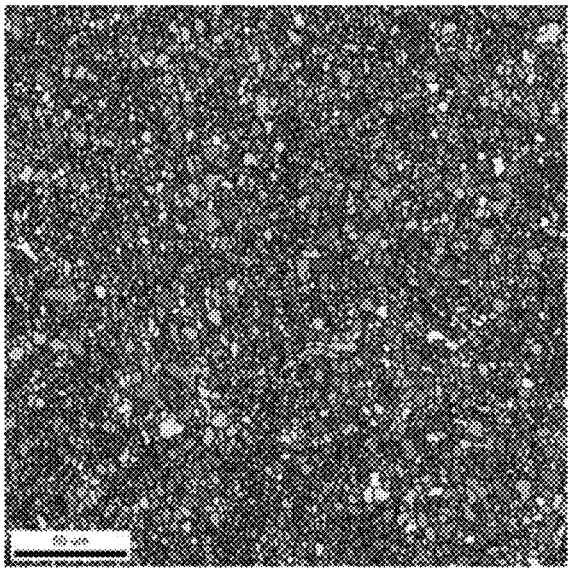
FIG. 11 is a micrograph after the annealing step of Example A3.

FIGS. 9, 10 and 11 show the microstructures after the annealing step of Comparative Example B5, Comparative Example B6 and Example A3, respectively.

As shown in FIG. 9, if necessary, refer to Table 1: the single-pass reduction in Comparative Example B5 is 10%; the deformation of the magnesium alloy sheet is small due to the small reduction, thus making the recrystallization of the sheet incomplete. The fraction of recrystallized grains is only 28%, the grains are coarse as shown in FIG. 9 and the average grain size is about 12 μm.

As shown in FIG. 10, if necessary, refer to Table 1: the single-pass reduction in Comparative Example B6 is 30%, which is larger than that of Comparative Example B5, resulting in a relatively large deformation of the magnesium alloy sheet; although the recrystallization of the magnesium alloy sheet is still incomplete, the fraction of recrystallized grains thereof is about 48%, higher than that of Comparative Example B5 and the average grain size thereof is smaller, about 7 μm.

As shown in FIG. 11, if necessary, refer to Table 1: the single-pass reduction in Example A3 is 50%, which is larger than that of Comparative Examples B5 and B6. The deformation of the magnesium alloy sheet is larger, the grain structure of the magnesium alloy sheet is clearly refined, and the large-size deformed grains are greatly reduced. Compared with the grain sizes of the magnesium alloy sheets of Comparative Examples B5 and B6 shown in FIGS. 9 and 10, the grain size of Examples A3 shown in FIG. 11 is smaller and the grain size thereof is more uniform. The average grain size is about 4 μm and the fraction of recrystallized grains reaches about 67%.

As shown in FIGS. 9 and 10 and in combination with the contents shown in Table 1, since Comparative Examples B5 and B6 use relatively low single-pass reductions, the recrystallized grain sizes are relatively large and the effects of recrystallization on grain refinement are not obvious in the microstructures after the annealing step of Comparative Examples B5 and B6. As shown in FIG. 11 and in combination with the contents shown in Table 1, since Example A3 uses a relatively high single-pass reduction, the effect of recrystallization is obvious, the grain size is small and the grain size is uniform in the microstructure of Example A3.

Figure 12:
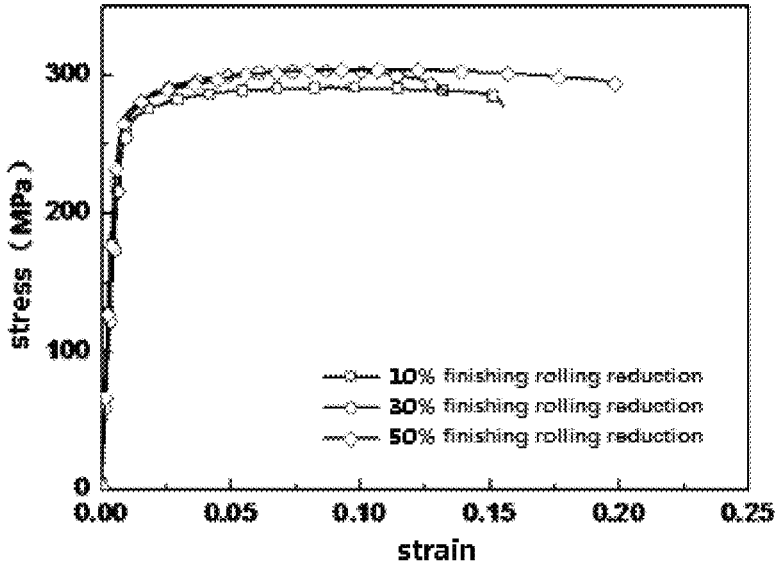
FIG. 12 is a graph showing the relationship between the reduction and the tensile curve at room temperature of Example A3, Comparative Example B5, and Comparative Example B6.

FIG. 12 shows the relationship between the single-pass reduction and the tensile curve at room temperature of Example A3, Comparative Example B5 and Comparative Example B6.

As shown in FIG. 12 and in combination with Tables 1 and 2, the single-pass reduction in Comparative Example B5 is 10%, the single-pass reduction in Comparative Example B6 is 30%, while the single-pass reduction in Example A3 is 50%; the stress and strain index of the magnesium alloy sheet increase with the increase of the single-pass reduction. Specifically, the yield strength, tensile strength, uniform elongation and elongation of Example A3 are all higher than the yield strength, tensile strength, uniform elongation and elongation of Comparative Examples B5 and B6.

It should be noted that the above is only specific Examples of present invention. It is obvious that present invention is not limited to the above Examples, and there are many similar changes. All variations that a person skilled in the art derives or associates directly from the disclosure of present invention shall fall within the protection scope of present invention.

The invention claimed is:

1. A rolling process for magnesium alloy sheets, wherein billets are rolled in a rough rolling step and a high-efficiency hot rolling step, and wherein, in the rough rolling step, a reduction of each pass is 10-30%, and a rolling speed of each pass is 10 m/min to 45 m/min, and in the high-efficiency hot rolling step, a rolling speed in each rolling pass is 10-50 m/min, rolling reduction in each rolling pass is 40-90%, the billets are preheated 1-15 min before rolling in each rolling pass, and the temperature of the preheating before rolling and a temperature of rolling in each rolling pass are controlled to be 250-450° C.

2. A method for producing magnesium alloy sheets, comprising the following steps of:

1) preparing rolled magnesium alloy billets by a rough rolling, wherein a reduction of each pass is controlled to be 10-30% and a rolling speed of each pass is controlled to be 10 m/min to 45 m/min, 2) effectively hot-rolling the rolled magnesium alloy billets to at least a target level, wherein rolling speed in each rolling pass is 10-50 m/min, rolling reduction in each rolling pass is controlled to be 40-90%, and the rolled magnesium alloy billets are preheated 1-15 min before rolling in each rolling pass, and a temperature of the preheating before rolling and a temperature of rolling in each rolling pass are controlled to be 250-450° C., and 3) annealing at an annealing temperature of 150-400° C. and annealing time of 10-300 s.

3. The method according to claim 2, wherein in the step 1), the step of preparing the rolled magnesium alloy billets comprises smelting and casting an ingot, homogenization treatment, sawing the ingot and rough rolling the ingot.

4. The method according to claim 3, wherein in the step 1), the rolled magnesium alloy billets are preheated before each pass of rough rolling, and preheating temperature and rolling temperature in each pass of rough rolling are controlled to be 250-450° C.

5. The method according to claim 2, wherein in the step 1), the step of preparing the rolled magnesium alloy billets is prepared by a twin-roll casting method.

* * * * *